US005380949A

United States Patent [19]

Matsuda

[11] Patent Number: 5,380,949

[45] Date of Patent: Jan. 10, 1995

[54] KEY ASSIGNER FOR AN ELECTRONIC MUSICAL INSTRUMENT HAVING MULTIPLE TONE CHANNELS AND PRIORITY LEVEL VALUE DATA

[75] Inventor: Eiji Matsuda, Shizuoka, Japan

[73] Assignee: Kabushiki Kaisha Kawai Gakki Seisakusho, Japan

[21] Appl. No.: 21,756

[22] Filed: Feb. 24, 1993

[30] Foreign Application Priority Data

Mar. 31, 1992 [JP] Japan ..... 4-103758

[51] Int. Cl.[6] ..... G10H 7/00; G10H 1/22

[52] U.S. Cl. ..... 84/618; 84/656

[58] Field of Search ..... 84/618, 617, DIG. 2, 84/655, 656

[56] References Cited

U.S. PATENT DOCUMENTS

| | | | |
|---|---|---|---|
| 4,703,680 | 11/1987 | Wachi et al. | 84/615 |
| 4,911,052 | 3/1990 | Saito et al. | 84/617 |
| 4,969,385 | 11/1990 | Williams et al. | 84/DIG. 2 |
| 5,159,144 | 10/1992 | Fujisawa et al. | 84/DIG. 2 |
| 5,218,154 | 6/1993 | Kondo | 84/618 |
| 5,280,129 | 1/1994 | Yamamori et al. | 84/656 |
| 5,286,910 | 2/1994 | Hasebe | 84/609 |
| 5,315,059 | 5/1994 | Saito | 84/656 |

*Primary Examiner*—William M. Shoop, Jr.
*Assistant Examiner*—Jeffrey W. Donels
*Attorney, Agent, or Firm*—Andrus, Sceales, Starke & Sawall

[57] ABSTRACT

A key assigner for an electronic musical instrument having multiple tone channels for tone signals generated by tone signal generator means controlled by a tone signal generation instruction input device. The key assigner includes a random access memory having an assignment table for storing priority level value data for each of the multiple tone channels for controlling the order in which musical tone signals present in the tone channels are halted when new tone signals are to be generated. An assigner halts the existing tone signal for the tone channel having the lowest priority level value in the assignment table upon the generation of a new tone signal instruction and assigns the new musical tone signal to that tone channel. A control provides priority level value data for storage in the memory in consonance with musical attribute data for the new musical tone, such as sustainment or attenuation of the new tone.

5 Claims, 6 Drawing Sheets

| NO. | RANK | ON / OFF |
|---|---|---|
| 1 | 19 △ | OFF |
| 2 | 16 | OFF |
| 3 | 20 △ | ON |
| 4 | 17 | OFF |
| 5 | 21 △ | ON |
| 6 | 18 | OFF |
| 7 | 22 △ | ON |
| 8 | 19 | ON |
| 9 | 23 △ | ON |
| 10 | 20 | ON |

FIG. 4A

→

| NO. | RANK | ON / OFF |
|---|---|---|
| 1 | 18 △ | OFF |
| 2 | 20 | ON |
| 3 | 19 △ | ON |
| 4 | 23 △ | ON |
| 5 | 20 △ | ON |
| 6 | 17 | OFF |
| 7 | 21 △ | ON |
| 8 | 18 | ON |
| 9 | 22 △ | ON |
| 10 | 19 | ON |

FIG. 4B

→

| NO. | RANK | ON / OFF |
|---|---|---|
| 1 | 23 △ | ON |
| 2 | 19 | ON |
| 3 | 18 △ | ON |
| 4 | 22 △ | ON |
| 5 | 19 △ | ON |
| 6 | 20 | ON |
| 7 | 20 △ | ON |
| 8 | 17 | ON |
| 9 | 21 △ | ON |
| 10 | 18 | ON |

FIG. 4C

→

| NO. | RANK | ON / OFF |
|---|---|---|
| 1 | 22 △ | ON |
| 2 | 18 | ON |
| 3 | 23 △ | ON |
| 4 | 21 △ | ON |
| 5 | 18 △ | ON |
| 6 | 19 | ON |
| 7 | 19 △ | ON |
| 8 | 20 | ON |
| 9 | 20 △ | ON |
| 10 | 17 | ON |

FIG. 4D

△ : SUSTAINED TONE

PRIORITY LEVEL FOR ATTENUATED TONE · · · "20"
PRIORITY LEVEL FOR SUSTAINED TONE · · · "23"

| NO. | RANK | ON / OFF |
|---|---|---|
| 1 | 16 | OFF |
| 2 | 16 | OFF |
| 3 | 17 | OFF |
| 4 | 17 | OFF |
| 5 | 18 | ON |
| 6 | 18 | ON |
| 7 | 19 | ON |
| 8 | 19 | ON |
| 9 | 20 | ON |
| 10 | 20 | ON |

PRIOR ART
FIG. 6C

→

| NO. | RANK | ON / OFF |
|---|---|---|
| 1 | 20 | ON |
| 2 | 20 | ON |
| 3 | 16 | OFF |
| 4 | 16 | OFF |
| 5 | 17 | ON |
| 6 | 17 | ON |
| 7 | 18 | ON |
| 8 | 18 | ON |
| 9 | 19 | ON |
| 10 | 19 | ON |

PRIOR ART
FIG. 6C

→

| NO. | RANK | ON / OFF |
|---|---|---|
| 1 | 19 | ON |
| 2 | 19 | ON |
| 3 | 20 | ON |
| 4 | 20 | ON |
| 5 | 16 | ON |
| 6 | 16 | ON |
| 7 | 17 | ON |
| 8 | 17 | ON |
| 9 | 18 | ON |
| 10 | 18 | ON |

PRIOR ART
FIG. 6C

→

| NO. | RANK | ON / OFF |
|---|---|---|
| 1 | 18 | ON |
| 2 | 18 | ON |
| 3 | 19 | ON |
| 4 | 19 | ON |
| 5 | 20 | ON |
| 6 | 20 | ON |
| 7 | 16 | ON |
| 8 | 16 | ON |
| 9 | 17 | ON |
| 10 | 17 | ON |

PRIOR ART
FIG. 6D

PRIORITY LEVEL ··· "20"

KEY ASSIGNER FOR AN ELECTRONIC MUSICAL INSTRUMENT HAVING MULTIPLE TONE CHANNELS AND PRIORITY LEVEL VALUE DATA

BACKGROUND OF THE INVENTION

1. Field of the Invention

The present invention relates to a key assigner for an electronic musical instrument, and more particularly to a technique for assigning tone channels to play music with natural sounding tonal qualities.

Recently, electronic musical instruments, such as electronic organs and electronic pianos, have been developed and are in practical use. Such electronic musical instruments generally have multiple tone channels to simultaneously produce a plurality of musical tones in response to the depression of multiple keys. In tone generation processing, electronic musical instruments employ their key assigners to determine along which tone channels musical tones corresponding to the respective depressed keys will be generated.

Generally, electronic musical instruments produce musical tones having timbres similar to those of various musical instruments. For example, by designating timbres in consonance with key ranges, electronic musical instruments can simultaneously produce musical tones with multiple timbres, such as attenuated tones similar to those produced by pianos and sustained tones similar to those produced by violins, on a single keyboard.

As electronic musical instruments have limited tone channels, however, the number of musical tones that can simultaneously be produced is also limited. To accomplish simultaneous tone production, a key assigner is utilized to select, from among those that are available, the tone channels along which musical tones are to be halted and those along which musical tones are to be generated. Since musical fidelity can be significantly deteriorated by the random assignment to tone channels of musical tones for keys, improved processing control is desirable.

2. Description of the Related Art

A process performed by a conventional key assigner for an electronic musical instrument will now be described while referring to the accompanying drawings.

FIG. 6 is used to illustrate the employment of an assignment table during a key assigning process.

The "No." column holds the tone channel numbers (ten tone channels, "1" to "10", are used in this example). The "RANK" column holds the priority level values assigned to the tone channels. These priority level values are the data that are used to determine the order in which tone channels are selected for tone generation halt when such processing is required. "20" is the maximum priority level value.

The "ON/OFF" column entries are employed to indicate which tone channels are being used. A tone channel for which an "ON" is entered is being used (key-ON), while a tone channel for which an "OFF" is entered is not being used (key-OFF).

A key assigning process using the above described assignment table will now be explained while referring to the flowchart shown in FIG. 5.

When tone generation is instructed by a processor (not shown), all of the tone channel priority level values in the assignment table are lowered by "1" (step S40). In other words, all the values that are entered in the "RANK" column are decremented by one. It should be noted that "0" is the lowest level to which these values are reduced.

Subsequently, a check is performed to determine whether there are any tone channels that have key-OFF entries (step S41). This determination is performed by examining the entries in the ON/OFF column of the assignment table. In the example shown in FIG. 6A, tone channels No. 1 through No. 4 are not being used. When tone channels with key-OFF entries are found, a comparison process is performed to determine which of these tone channels has the lowest priority level value (step S42).

Following this, a new priority level value, "20", is written into the RANK column of the assignment table for the selected tone channels, as is illustrated by the entries for tone channels No. 1 and No. 2 in FIG. 6B (step S44). The entries in the ON/OFF column for the affected tone channels are also updated to "ON". Tone generation is thereafter performed in agreement with the updated contents of the assignment table (step S45).

When, at step S41, no tone channels with key-OFF entries are found, the tone channel in the assignment table that has the lowest priority level value is selected, and the production of musical tones along that tone channel is halted (step S43). The example in FIG. 6C represents an instance where all tone channels are being used. In this case, tone channels No. 5 and No. 6 are identified as the tone channels that have the lowest priority level value and musical tones along these tone channels are halted.

Then, as is shown in FIG. 6D, a new priority level value, "20", is written in the priority column in the assignment table for the tone channels, No. 5 and No. 6, that were selected (step S44). Tone generation is thereafter performed in agreement with the updated contents of the assignment table (step S45).

As described above, when tone generation is newly instructed, a conventional key assigner uniformly lowers the priority level values of all the tone channels. If at this tinge there are any tone channels that are not in use, the maximum priority level value is entered for one of the tone channels, the one that has the lowest priority level value, and musical tones are generated along that tone channel.

If all the tone channels are being used, musical tones along the tone channel that has the lowest priority level value are halted. That tone channel is then newly designated for tone generation and is assigned the maximum priority level value. During this process, therefore, musical tones along the selected tone channel are halted regardless of whether they are attenuated tones or sustained tones.

That is, if a sustained tone is selected as the musical tone to be halted (i.e., its priority level value is the lowest), even though the key that controls the sustained tone is depressed, that tone is accordingly halted, and musical fidelity is impaired.

SUMMARY OF THE INVENTION

To overcome the described shortcoming, it is an object of the present invention to provide a key assigner, to be used with an electronic musical instrument, that controls the timing for tone generation halts in consonance with the attributes of the musical tones that are being produced, and thereby maintains musical fidelity.

A key assigner, for an electronic musical instrument having multiple tone channels, according to the present invention comprises:

an assignment table wherein for each of multiple tone channels is stored priority level data for controlling the order in which musical tones along the tone channels are to be halted;

assigning means for, when tone generation is instructed, performing a tone generation halt for the tone channel in the assignment table that has the lowest priority level value, and assigning to that tone channel the generation of a new musical tone; and control means for storing a different priority level value in the assignment table in consonance with an attribute of a musical tone to be generated along the tone channel assigned by the assigning means.

According to one aspect of the present invention, if a new tone generation instruction is made while all the tone channels are in use, and for tone generation of the new musical tone one of the channels must therefore be freed, i.e., tone generation along that tone channel must be halted, the priority level values recorded in the assignment table are examined, tone generation is halted along the tone channel that has the lowest priority level value, and the affected tone channel is reallocated for generation of the new musical tone.

At this time, the attribute of the musical tone that is newly assigned is ascertained, and, in consonance with that attribute, updated priority level data is written in the assignment table. If the determining attributes for musical tones are attenuation and sustainment, a larger priority level value is entered in the assignment table for a sustained tone than the value that is entered therein for an attenuated tone.

As the tone channel assignment duration of sustained tones is greater than that of attenuated tones, and as sustained tones are therefore produced relatively longer than attenuated tones, premature halting of sustained tones does not occur and musical fidelity is not impaired.

BRIEF DESCRIPTION OF THE DRAWINGS

FIGS. 4A to 4D are tables for illustrating the tone-ON process in FIG. 2;

FIGS. 6A to 6D are tables for illustrating the conventional key assigning process.

DETAILED DESCRIPTION OF THE PREFERRED EMBODIMENT

The preferred embodiment of the present invention will now be described while referring to the accompanying drawings.

Figure 1:
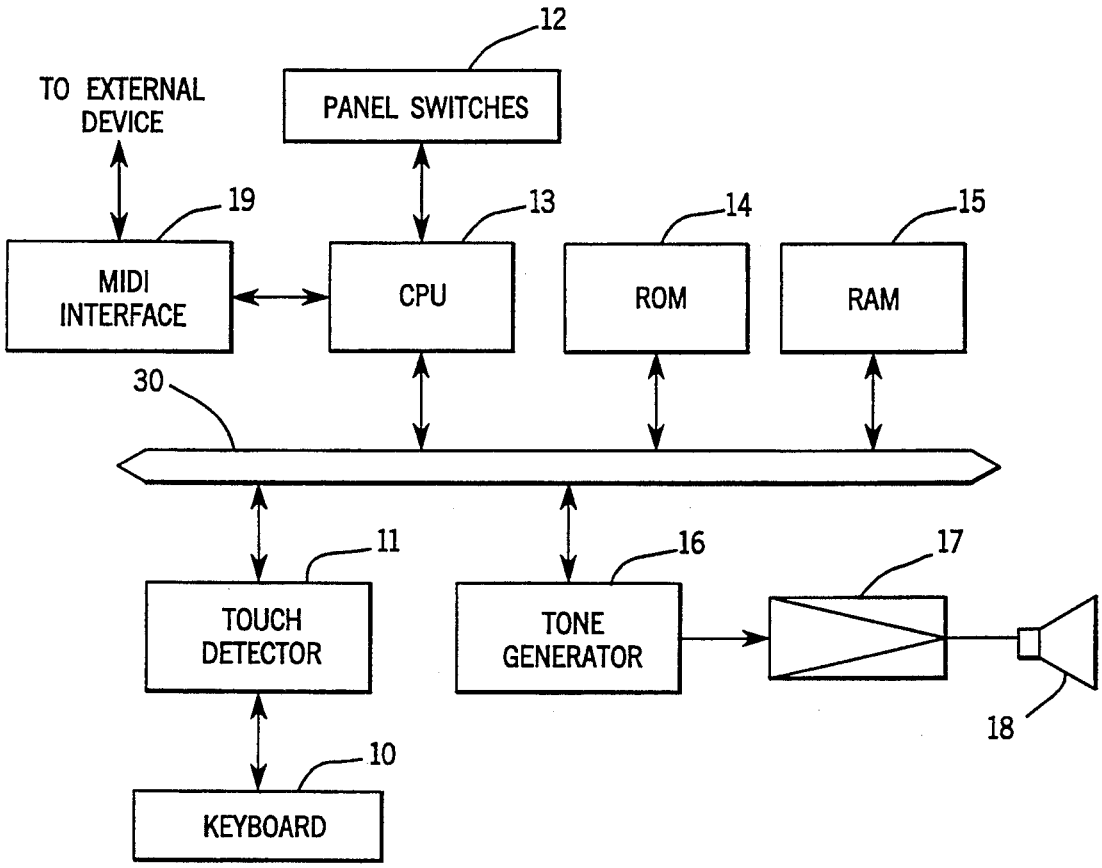
FIG. 1 is a schematic block diagram illustrating the general structure of one embodiment of an electronic musical instrument that employs a key assigner according to the present invention.

FIG. 1 is a schematic block diagram showing the general structure of an electronic musical instrument wherein a key assigner according to the present invention is employed.

A keyboard 10 is used to select a musical tone that is to be generated. The keyboard 10 includes multiple keys and their concomitant key switches (neither shown) that close or open as the keys are depressed or released, and a key scan circuit (also not shown) that detects the closed/open states of the key switches.

From the keyboard 10, a signal that indicates a key switch ON/OFF state that has been detected by the key scan circuit is sent to a touch detector 11.

Upon reception of the switch ON/OFF state data signal, the touch detector 11 generates touch data that express the strength (velocity) of key depression numerically, and also outputs ON/OFF data or data that identifies a depressed/released key, i.e., key number data. The ON/OFF data, the key number data, and the touch data are sent to a central processing unit (CPU) 13 via a system bus 30.

Panel switches 12, provided on an operation panel (not shown), are used to control the various operations of the electronic musical instrument. The panel switches 12 include a timbre select switch, a rhythm select switch, and a volume switch.

For the panel switches 12 is provided a panel scan circuit (not shown) that detects switch open/closed states. The switch open/closed states that are detected by the panel scan circuit are sent to the CPU 13.

The CPU 13 employs a control program that is stored in a read only memory (hereafter referred to as "ROM") 14 to control the individual sections of the electronic musical instrument. In the present invention, the key assigner function is performed by the CPU 13.

The ROM 14 stores not only the control program but also various datum constants to be used by the CPU 13. The ROM 14 is accessed by the CPU 13 via the system bus 30.

In a random access memory (hereafter referred to as "RAM") 15, are defined a work area for the CPU 13, and various registers, counters, flags, etc. for controlling the electronic musical instrument. The RAM 15 is accessed by the CPU 13 via the system bus 30. An assignment table to be used in this embodiment is also provided in the RAM 15.

A tone generator 16, in consonance with predetermined information supplied by the CPU 13, reads tone wave data and envelope data from a tone wave memory (not shown), adds an envelope to the read-out tone wave data, and outputs the resultant data as a tone signal. This tone signal is sent by the tone generator 16 to an amplifier 17.

The amplifier 17 amplifies the received tone signal by a predetermined gain and sends the resultant signal to a loudspeaker 18. The loudspeaker 18 is a well known one that converts an electric signal into an acoustic signal.

A MIDI interface circuit 19 controls reception and transmittance of MIDI signals passed between the CPU 13 and an external device.

The touch detector 11, the CPU 13, the ROM 14, the RAM 15, and the tone generator 16 are mutually connected by the system bus 30.

With the above described arrangement, the operation of the embodiment of the present application will now be explained while referring to the accompanying flowcharts.

Figure 2:
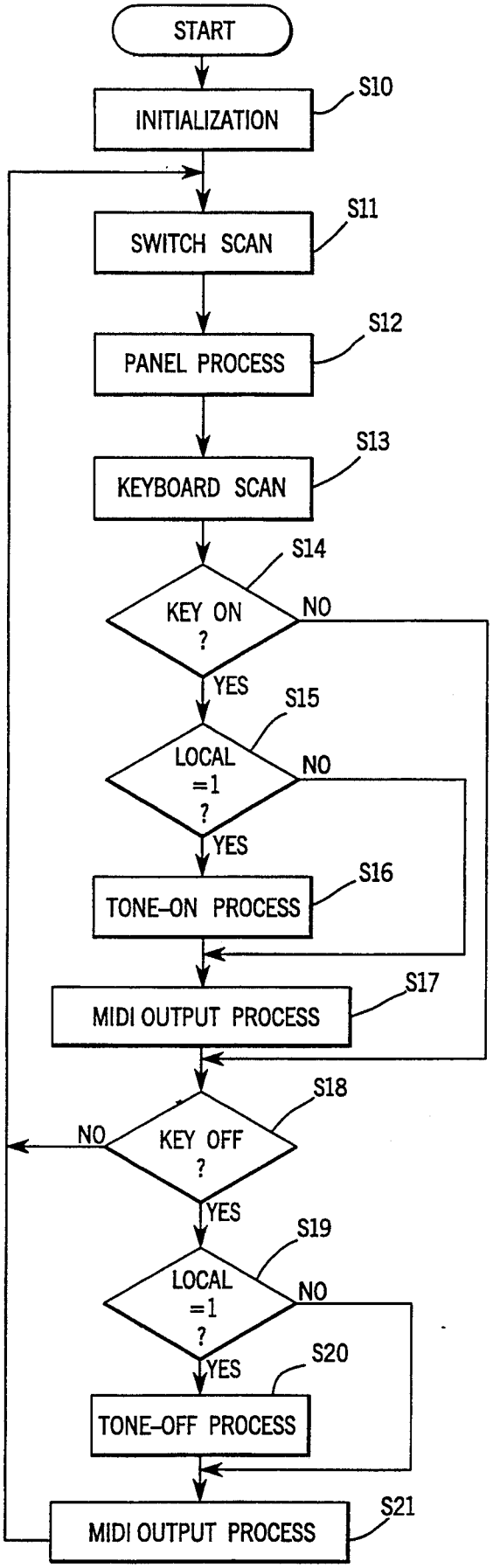
FIG. 2 is a flowchart (main routine) for explaining the processing operation of the embodiment according to the present invention.

When an electronic musical instrument is switched on, initialization of the main routine shown in FIG. 2 is performed and processing is begun. The initialization process is performed first (step S10).

During this process the initial internal state of the tone generator 16 is set so as to prevent the production of unwanted sounds that may occur when the power is switched on, the work area in the RAM 15 is cleared, and the registers, the counters, the flags, etc. (which are defined in the RAM 15) are set to their initial states. In the assignment table, the lowest priority level value (for example, "00") is entered for all the tone channels and all the entries in the ON/OFF column are OFF.

Following this, a switch scan process is performed (step S11). For this process are employed a NEW buffer, an OLD buffer and an EVENT buffer (none of them shown), each of which is provided to store data related to the panel switches.

The data most recently received from the panel switches are stored in the NEW buffer, and the data that were previously received from the panel switches are stored in the OLD buffer. The EVENT buffer is used to store data that indicate whether or not switch events have occurred, and data that indicate the event types. Table 1 shows the organization of the EVENT buffer as it relates to the panel switches.

TABLE 1

| setup value | event information |
|---|---|
| 0 | no change |
| 1 | set to ON state |
| 2 | set to OFF state |

During the switch scan process, switch data are received from the panel scan circuit for the panel switches 12, and those data are stored in the NEW buffer. Then, the contents of the NEW buffer are compared with those of the OLD buffer. When they are found to be the same, since the currently read data and the previously read data are identical, it is assumed that no switch event change has occurred and the setup value in the EVENT buffer is set to "0".

When the contents of the NEW buffer do not equal those of the OLD buffer, a check is performed to determine whether a change from "0" to "1" has been made. In other words, a check is performed to determine whether the value stored in the OLD buffer is "0" and the value stored in the NEW buffer is "1".

When a change from "0" to "1" is found to have been made, it is assumed that an ON event has occurred and the setup value in the EVENT buffer is set to "1". If a change from "0" to "1" has not been made, it is assumed that an OFF event has occurred and the setup value in the EVENT buffer is set to "2".

As described above, data that indicate whether a switch event has occurred, and when one has occurred, data that indicate whether that event is an ON event or OFF event, are stored in the EVENT buffer.

Subsequently, a panel process is performed for each panel switch at which the occurrence of an event was detected during the switch scan process (step S12). For example, in consonance with the manipulation of a timbre select switch, a rhythm select switch or a volume switch, a timbre change process, a rhythm change process or a volume control process is performed.

Following this, a keyboard scan process is performed (step S13). For this process are employed a NEWKEY buffer, an OLDKEY buffer and an EVENTKEY buffer, each of which is provided in the RAM 15 and each of which includes areas that correspond to keys 01 to 88.

The data most recently received from the keyboard 10 are stored in the NEWKEY buffer, and the data that were previously received from the keyboard 10 are stored in the OLDKEY buffer. These buffers each include a one-byte area for each key. In each byte, datum indicating the key ON/OFF state ("0" is key-OFF and "1" is key-ON) is stored in the MSB (Most Significant Bit) (bit 7), while touch data are stored in the remaining seven bits (bits 0 to 6).

The EVENTKEY buffer is used to store both data that indicate whether or not key events have occurred, and data that indicate the event types. The organization of the EVENTKEY buffer, as it relates to keys on the keyboard 10, is shown in Table 1 above.

During the keyboard scan process, first, keyboard data is input. In other words, key number data, key ON/OFF data, and touch data are input from the touch detector 11, and are stored in the NEWKEY buffer.

Then, the contents of the NEWKEY buffer are compared with those of the OLDKEY buffer. When they are found to be the same, the setup value in the EVENTKEY buffer is set to "0". That is, since the currently read data and the previously read data are identical, and since no switch event change has occurred, the setup value in the EVENTKEY buffer is set to "0".

When the contents of the NEWKEY buffer do not equal those of the OLDKEY buffer, a check is performed to determine whether a change from "0" to "1" has been made. In other words, a check is performed to determine whether the value stored in the OLDKEY buffer is "0" and the value stored in the NEWKEY buffer is "1".

When a change from "0" to "1" is found to have been made, it is assumed that an ON event has occurred and the setup value in the EVENTKEY buffer is set to "1". If a change from "0" to "1" has not been made, it is assumed that an OFF event has occurred and the setup value in the EVENTKEY buffer is set to "2".

As described above, data that indicate whether a key switch event has occurred, and when one has occurred, data that indicate whether that event is an ON event or OFF event, are stored in the EVENTKEY buffer.

A check is then performed to determine whether or not a key is in the ON state (step S14). In other words, whether or not a key-ON event has occurred is determined by examining the EVENTKEY buffer that is prepared during the keyboard scan process.

When a key-ON event is found to have occurred, a check is performed to determine whether or not the value held by a flag LOCAL is "1" (step S15).

The flag LOCAL, defined in the RAM 15, is used to indicate whether or not tone production will be performed when the keys on the keyboard 10 of the electronic musical instrument are depressed. The flag LOCAL is set or reset by a predetermined manipulation of the panel switches 12.

When, at step S15, the value held by the flag LOCAL is found to be "1", it is assumed that tone production is to be performed using the keyboard 10 of the electronic musical instrument, and a tone-ON process is performed (step S16). The key assigning is performed as part of this tone-ON process. The details of the key assigning process will be described later.

Then, a MIDI output process is performed (step S17). More specifically, the key-ON event information (play data used in the tone-ON process) is sent as MIDI information via the MIDI interface circuit 19 to an external device. Tone generation, or recording, by the external device is thereafter performed.

If, at step S15, the value held by the flag LOCAL is found to be "0", it is assumed that tone production is not to be performed using the keyboard 10. The tone-ON process (step S16) is omitted and only the MIDI output process (step S17) is performed. That is, the electronic musical instrument does not generate musical tones; musical tones are generated, or recording is performed, by an external device.

If, at step S14, a key-ON event has not occurred, the tone-ON process (step S16) and the MIDI output process (step S17) are omitted.

A check is then performed to determine whether or not a key is in the OFF state (step S18). In other words, whether or not a key-OFF event has occurred is determined by examining the EVENTKEY buffer that is prepared during the keyboard scan process.

When a key-OFF event is found to have occurred, a check is performed to determine whether or not the value held by the flag LOCAL is "1" (step S19).

When the value held by the flag LOCAL is found to be "1", it is assumed that a tone generation halt is to be performed by the keyboard 10 of the electronic musical instrument, and a tone-OFF process is then executed (step S20). During this process, the tone generation assignments of the tone channels that are being used are released and tone generation is halted. In the ON/OFF column of the assignment table, the entries for the affected tone channels are changed to OFF.

Then, a MIDI output process is performed (step S21). More specifically, the key-OFF event information (play data used in the tone-OFF process) is sent as MIDI information via the MIDI interface circuit 19 to an external device. Accordingly, tone generation is halted, or recording is performed, by the external device.

If, at step S19, the value held by the flag LOCAL is found to be "0", it is assumed that a tone generation halt employing the keyboard 10 is not to be performed. The tone-OFF process (step S20) is omitted and only the MIDI output process (step S21) is performed. That is, the generation of musical tones is not halted by the electronic musical instrument; the generation of musical tones is halted, or recording is performed, by an external device.

Program control then returns to step S11 and the described process is repeated. Tone generation, with a timbre, a volume and a tempo that are selected using the panel switches 12, in consonance with key depression is performed; or tone generation halt in consonance with key release is performed.

If, at step S18, a key-OFF event has not occurred, the tone-OFF process (step S20) and the MIDI output process (step S21) are omitted. Program control returns to step S11 and the above described process is repeated.

Figure 3:
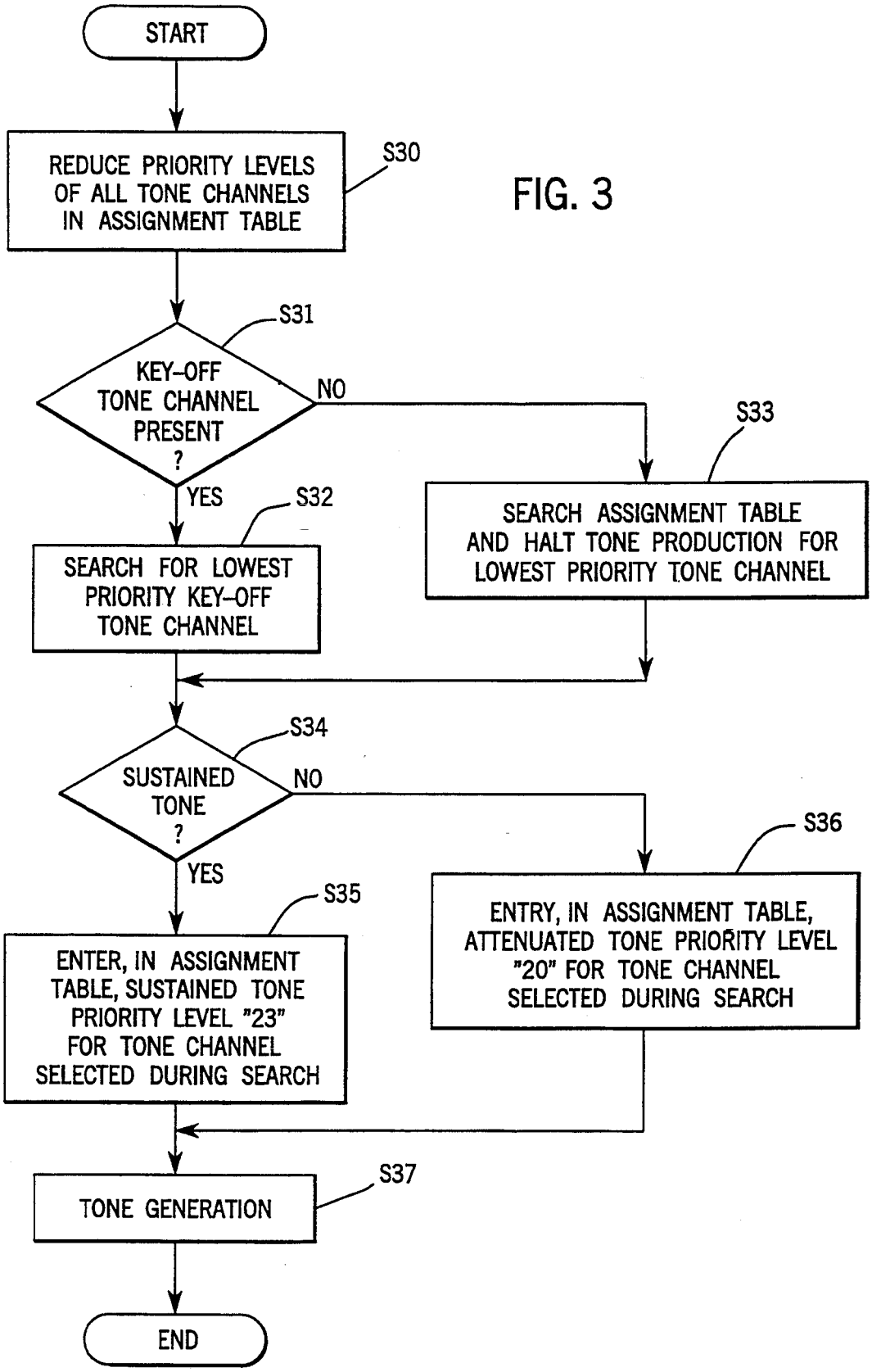
FIG. 3 is a flowchart for explaining the tone-ON process in FIG. 2.
Figure 5:
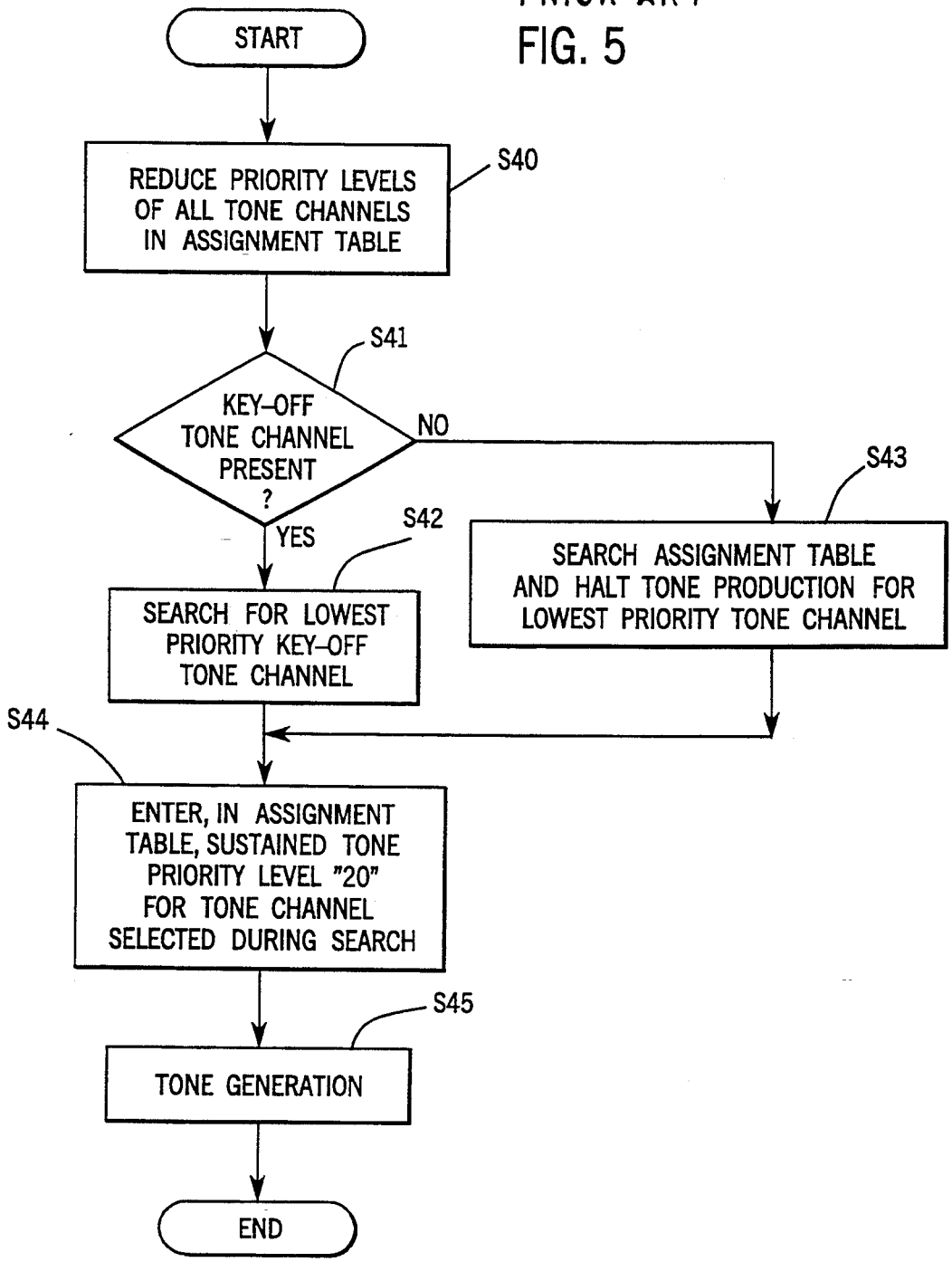
PRIOR ART FIG. 5
FIG. 5 is a flowchart for explaining a conventional key assigning process.

The key assigning process performed during the tone generation processing will now be described while referring to the flowchart in FIG. 3. FIG. 4 is used to illustrate the employment of an assignment table during a key assigning process.

The "No." column holds the tone channel numbers (ten tone channels, "1" to "10", are used in this example). The "RANK" column holds the priority level values assigned to the tone channels. These priority level values are the data that are used to determine the order in which tone channels are selected for tone generation halt when such processing is required. "20" is the maximum priority level value for an attenuated tone, and "23" is the maximum priority level value for a sustained tone. In this example, tone production is performed along two tone channels in response to a single tone generation instruction.

The "ON/OFF" column entries are employed to indicate which tone channels are being used. A tone channel for which an "ON" is entered is being used (key-ON), while a tone channel for which an "OFF" is entered is not being used (key-OFF).

A key assigning process sequence using the above described assignment table will now be explained while referring to the flowchart shown in FIG. 3.

During the tone generation processing routine, all of the tone channel priority level values in the assignment table are lowered by "1" (step S30). In other words, all the values that are entered in the "RANK" column are decremented by one. It should be noted that "0" is the lowest level to which these values are reduced.

Subsequently, a check is performed to determine whether there are any tone channels that have key-OFF entries (step S31). This determination is performed by examining the entries in the ON/OFF column of the assignment table. In the example shown in FIG. 4A, tone channels No. 1, 2, 4, and 6 are not being used.

When tone channels with key-OFF entries are found, a comparison process is performed to determine which of the tone channels has the lowest priority level value (step S32). In the example shown in FIG. 4A, tone channels No. 2 and No. 4 are identified as the tone channels that have the lowest priority level values.

When, at step S31, no tone channels with key-OFF entries are found, the tone channel in the assignment table that has the lowest priority level value is selected and the production of musical tones along that tone channel is halted (step S33). The example in FIG. 4C represents an instance where all tone channels are being used. In this case, tone channels No. 3 and No. 8 are identified as the tone channels that have the lowest priority level values and musical tones along these tone channels are halted.

Following this, a check is made to determine whether or not the musical tone to be newly produced is a sustained tone (step S34). This determination is performed by examining the timbre of the musical tone that is to be produced.

When the musical tone is found to be a sustained tone, priority level value "23" is entered in the assignment table for the relevant tone channel (step S35). If the musical tone is found to be an attenuated tone, priority level value "20" is entered in the assignment table for the relevant tone channel (step S36).

Tone generation is then performed in accordance with the updated contents of the assignment table (step S37).

FIG. 4 illustrates key assigning processing. When there are unused tone channels, sequential key assigning processing, as is depicted in FIGS. 4A, 4B and 4C, is performed, and the ON/OFF column entries for tone channels selected during this processing are updated to ON. When there are no unused tone channels, key assigning is performed in the manner depicted in FIGS. 4C and 4D.

As described above, according to the present invention, if new tone generation is instructed while all the tone channels are in use, and to initiate tone generation for the new musical tone one of the channels must therefore be freed, i.e., tone generation along that tone channel must be halted, priority level values entered in the assignment table are examined and tone generation is halted along a tone channel that has the lowest priority level value. The affected tone channel is then reallocated for generation of the new musical tone.

At this time, the new musical tone is evaluated to determine whether it is an attenuated tone or a sustained tone, and updated priority level data that is appropriate for the determining attribute is entered in the assignment table. In this example, if a musical tone is attenuated, the priority level value "20" is entered in the assignment table; but if a musical tone is sustained, the priority level value "23" is entered therein.

As the tone channel assignment duration for sustained tones exceeds that for attenuated tones, and as sustained tones are therefore produced relatively longer than attenuated tones, premature halting of sustained tones does not occur and musical fidelity is not impaired.

In the above described embodiment, the timing for tone generation halt procedures is controlled by assigning to tone channels different priority level values for tone attenuation and tone sustainment, but other attributes of musical tones can also be utilized in this manner. It is therefore possible to determine the optimal timing for a tone generation halt in consonance with an attribute of a musical tone that is being produced, and to thus play music with natural sounding tonal qualities.

As described above in detail, the present invention provides a key assigner, to be used with an electronic musical instrument, that controls the timing for tone generation halts in consonance with the attributes of the musical tones that are being produced, and thereby maintains musical fidelity.

What is claimed is:

1. A key assigner for an electronic musical instrument having multiple tone channels for tone signals generated by tone signal generator means controlled by a tone signal generation instruction input device, said key assigner comprising:

means having an assignment table for storing priority level value data for each of the [multiple]tone channels for controlling the order in which musical tone signals present in the tone channels are halted;

assigning means coupled to said assignment table means and to the input device for halting the existing tone signal for the tone channel having the lowest priority level value in said assignment table upon the generation of a new tone signal instruction, and for assigning the new tone signal to the tone channel having the lowest priority level value; and control means coupled to said assignment table means for determining and providing initial priority level value data, upon the generation of a new tone signal instruction, in consonance with musical attribute data indicative of the sustainment or attenuation properties of the new tone assigned by said assigning means, said initial priority level valve data being stored in said assignment table, said control means uniformly and repetitively altering the priority level value data in said assignment table means for each of the tone channels responsive to the generation of tone signal instructions.

2. A key assignor for an electronic musical instrument according to claim 1, wherein said assignment table means comprises a RAM having recorded therein, for each of said tone channels, priority level data values for controlling the order in which tone production by said tone channels is to be halted.

3. A key assigner for an electronic musical instrument according to claim 1 wherein said assignment table means is further defined as having status means, the output state of which is indicative of whether each of the tone channels is in a state of use or a state of non-use, wherein the priority level value data has differing values depending on the channel assignment priority, and wherein said assignment table means is further defined as setting the priority level value data for each channel to the lowest value and for operating the status means so that the output state indicates the non-use state for all channels when said assignment table means is initialized.

4. A key assigner for an electronic musical instrument according to claim 1 wherein said assignment table means stores priority level value data of differing values indicative of the usage priority of the tone channels and wherein said assigning means is further defined as means for halting the existing tone signal in a tone channel having the lowest priority level value and for assigning that tone channel to the generation of the new musical tone.

5. A key assigner for an electronic musical instrument according to claim 1 wherein said control means is further defined as providing a higher priority level value to said assignment table means for musical attribute data indicative of sustainment of the new musical tone than for musical attribute data indicative of attenuation of the new musical tone.

* * * * *

UNITED STATES PATENT AND TRADEMARK OFFICE

CERTIFICATE OF CORRECTION

PATENT NO. : 5,380,949

DATED : January 10, 1995

INVENTOR(S) : Matsuda

It is certified that error appears in the above-indentified patent and that said Letters Patent is hereby corrected as shown below:

CLAIM 1, Col. 9, Line 41, delete the word "multiple"

Signed and Sealed this

Second Day of May, 1995

*Attest:*

*Attesting Officer*

BRUCE LEHMAN

*Commissioner of Patents and Trademarks*